US009208974B2

(12) United States Patent
Liu

(10) Patent No.: US 9,208,974 B2
(45) Date of Patent: Dec. 8, 2015

(54) DISK TYPE OFF-CIRCUIT TAP CHANGER

(71) Applicant: WUHAN TAIPU TRANSFORMER CHANGER CO., LTD., Wuhan (CN)

(72) Inventor: Xin Liu, Wuhan (CN)

(73) Assignee: WUHAN TAIPU TRANSFORMER CHANGER CO., LTD., Wuhan (CN)

( * ) Notice: Subject to any disclaimer, the term of this patent is extended or adjusted under 35 U.S.C. 154(b) by 272 days.

(21) Appl. No.: 13/912,657

(22) Filed: Jun. 7, 2013

(65) Prior Publication Data

US 2013/0327620 A1 Dec. 12, 2013

(30) Foreign Application Priority Data

Jun. 8, 2012 (CN) ..... 2012 2 0268519 U
Jun. 8, 2012 (CN) ..... 2012 2 0268527 U

(51) Int. Cl.

| | |
|---|---|
| ***H01H 1/42*** | (2006.01) |
| ***H01H 19/56*** | (2006.01) |
| ***H01H 19/08*** | (2006.01) |
| ***H01H 9/00*** | (2006.01) |

(52) U.S. Cl.

CPC ..... *H01H 19/08* (2013.01); *H01H 9/0016* (2013.01)

(58) Field of Classification Search

None

See application file for complete search history.

(56) References Cited

U.S. PATENT DOCUMENTS

| | | | | |
|---|---|---|---|---|
| 1,725,078 | A * | 8/1929 | Hill | 200/8 R |
| 7,750,257 | B2 * | 7/2010 | Lindsey et al. | 200/11 TC |
| 2013/0327619 | A1 * | 12/2013 | Liu et al. | 200/11 TC |

FOREIGN PATENT DOCUMENTS

| | | | | |
|---|---|---|---|---|
| CN | 2062483 | * | 9/1990 | H01F 29/04 |
| CN | 2062483 | U | 9/1990 | |

* cited by examiner

*Primary Examiner* — Edwin A. Leon
*Assistant Examiner* — Ahmed Saeed
(74) *Attorney, Agent, or Firm* — Tim Tingkang Xia, Esq.; Locke Lord LLP

(57) ABSTRACT

In one aspect of the present invention, a disk type off-circuit tap changer includes a switch base and a rotation shaft, where an upper end of the rotation shaft is connected to an operation positioning mechanism, a lower end of the rotation shaft is connected to moving contacts, the moving contacts fit with fixed contacts circumferentially arranged at a lower side of the switch base, and the fixed contacts are directly embedded into the switch base to form a whole body with the switch base.

11 Claims, 3 Drawing Sheets

DISK TYPE OFF-CIRCUIT TAP CHANGER

CROSS-REFERENCE TO RELATED APPLICATION

This application claims the priority to Chinese Patent Application Nos. CN201220268519.4 and CN201220268527.9, filed Jun. 8, 2012, in the State Intellectual Property Office of P.R. China, which are hereby incorporated herein in their entireties by reference.

FIELD OF THE INVENTION

The present invention relates to a disk type off-circuit tap changer for a transformer.

BACKGROUND OF THE INVENTION

Chinese Patent No. CN2062483U discloses an off-circuit tap changer, where a flange plate, an upper disk, and a lower disk are fixedly connected to form a cavity of the tap changer, an insulating boss is disposed between two adjacent fixed contacts, and a moving contact is turned from one fixed contact to another adjacent fixed contact through the insulating boss during the gear shifting of the tap changer, so as to implement gear shifting and voltage regulations. The upper disk and the lower disk of the tap changer are assembled in a thread manner, and the fixed contact and the lower disk are fixed with screws, which makes positioning in machining and assembly very complicated, and results in a higher overall cost.

Therefore, a heretofore unaddressed need exists in the art to address the aforementioned deficiencies and inadequacies.

SUMMARY OF THE INVENTION

One of the objectives of the present invention is to provide a disk type off-circuit tap changer with a simple structure and easy to made, so as to overcome the shortcomings in the prior art.

In one aspect of the present invention, a disk type off-circuit tap changer includes a switch base and a rotation shaft, where an upper end of the rotation shaft is connected to an operation positioning mechanism, a lower end of the rotation shaft is connected to moving contacts, the moving contacts fit with fixed contacts circumferentially arranged at a lower side of the switch base; and the fixed contacts are directly embedded into the switch base to form a whole body with the switch base.

In one embodiment, the switch base is an integrated structure.

In one embodiment, the fixed contacts and the switch base are integrally formed through injection molding or compression molding.

In one embodiment, an insulating boss is disposed between the fixed contacts, and the insulating boss and the switch base form a whole body and are integrally formed through injection molding or compression molding.

In one embodiment, the moving contact is an upper-and-lower clip moving contact, and a ternate slot is opened at the middle of the moving contact and is connected to a lower end of the rotation shaft in an insertion manner.

In one embodiment, the fixed contact is in a shape of a cylinder or a flat column, a front end thereof extends into an inner cavity of the switch base to form a contact terminal, and a rear end thereof extends out of the switch base and is bent downwards to form a wiring end.

In one embodiment, the fixed contact is in a shape of a flat column at the front and in a shape of a cylinder at the rear, the contact terminal at the front end and stretching into the inner cavity of the switch base is in a shape of a flat column, the wiring end at the rear, stretching out of the switch base and bent downwards is in a shape of a cylinder, and the middle section is a gradient transition section.

In one embodiment, the fixed contact in a shape of a cylinder or a flat column is a hollow tube, and is manufactured by using tube materials.

The beneficial effects of the present invention are as follows: 1. the fixed contacts are directly embedded into the switch base, and the switch base, the fixed contacts and the insulating boss are integrally formed, so the structure is simple and the positioning is correct; thereby, it is easy to process and manufacture the present invention, and the manufacturing cost is low; 2. the switch in an integrated structure has high manufacturing and assembly precision, and has high operational reliability; and 3. the fixed contact is in a shape of a cylinder or a flat column, so that the gear shifting for the moving contact is easy. The present invention is applicable to a disk-shaped off-circuit tap changer with various voltage regulating manners.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

DETAILED DESCRIPTION OF THE INVENTION

Figure 1:
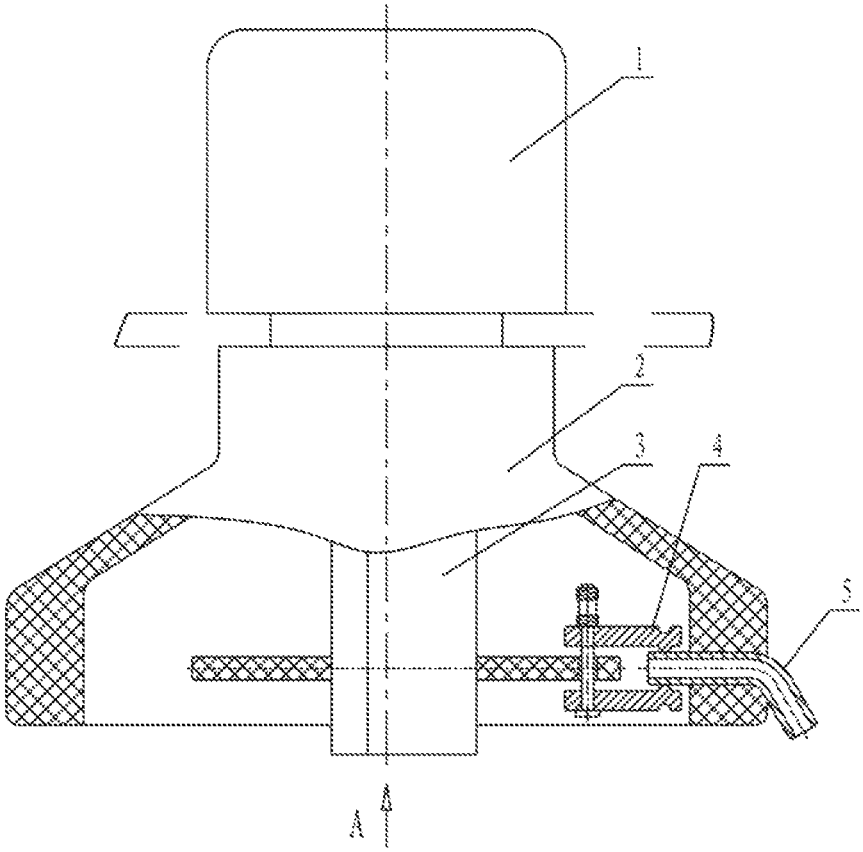
FIG. 1 is a front view of a disk type off-circuit tap changer according to one embodiment of the present invention.

The present invention is more particularly described in the following examples that are intended as illustrative only since numerous modifications and variations therein will be apparent to those skilled in the art. Various embodiments of this invention are now described in detail in conjunction with the accompanying drawings. Referring to the drawings, like numbers indicate like components throughout the views.

In accordance with the purposes of this invention, as embodied and broadly described herein, this invention, in one aspect, relates to a disk type off-circuit tap changer. Two embodiments of the present invention are described below with reference to the accompanying drawings of FIGS. 1-4.

Figure 2:
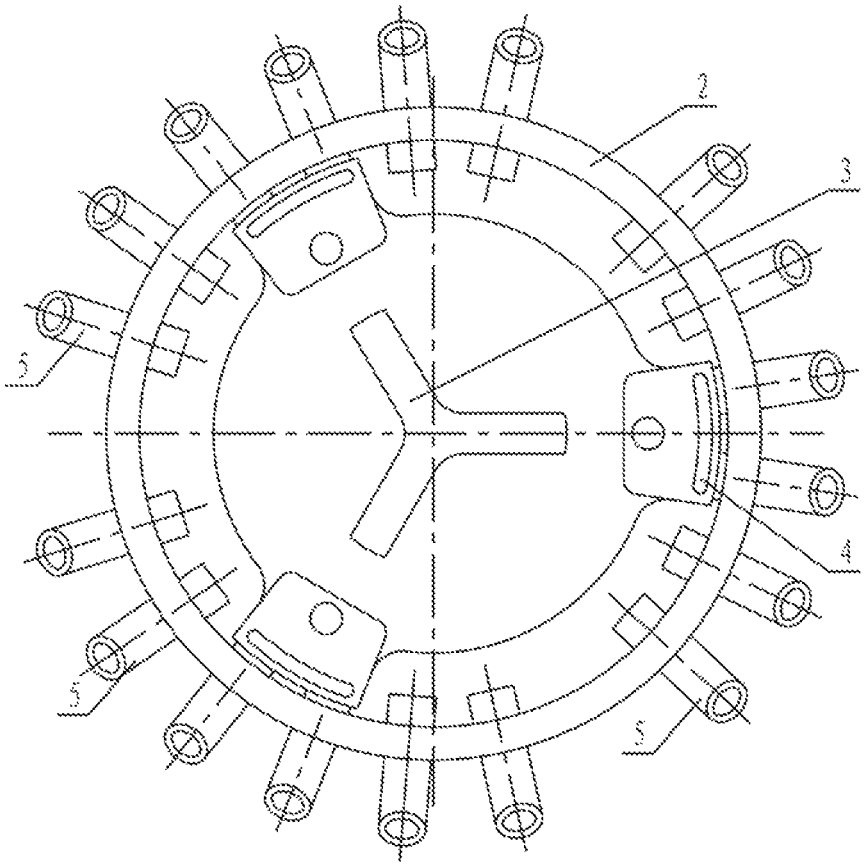
FIG. 2 is an A-direction view of the off-circuit tap changer shown in FIG. 1.

Referring to FIGS. 1 and 2, a three-phase disk type off-circuit tap changer is shown according to one embodiment of the present invention. In this exemplary embodiment, the three-phase disk type off-circuit tap changer includes a switch base 2 and a rotation shaft 3. The switch base 2 is an integrated structure; an upper end of the rotation shaft 3 is connected to an operation positioning mechanism 1, and a lower end of the rotation shaft 3 is connected to moving contacts 4. The moving contact 4 is an upper-and-lower clip-type moving contact, and includes an insulating drive plate and upper-and-lower clip-type moving contact pieces, a ternate slot is formed at the middle of the insulating drive plate and is connected to a lower end of the rotation shaft 3 in an insertion manner, the upper-and-lower clip moving contact pieces fit with the fixed contacts circumferentially arranged at a lower side of the switch base 2, and three upper-and-lower clip-type moving contact pieces exist, are circumferentially arranged and are nonconductive to each other. The fixed contact 5 is in a shape of a cylinder, a front end thereof extends into an inner cavity of the switch base 2 to form a contact terminal, and a rear end thereof extends out of the switch base 2 and is bent downwards to form a wiring end. The cylindrical fixed contact is a hollow tube and is manufactured by using copper tube materials. Three sets of fixed contacts corresponding to the moving contacts 4 are disposed, each set includes six fixed contacts, each upper-and-lower clip moving contact piece spans between two fixed contacts in each corresponding set, so that translocation and transformation can be performed. The fixed contacts 5 are directly embedded into the switch base 2, and are integrally formed with the switch base 2 through injection molding or compression molding, to form the switch base 2 in an integrated structure. The fixed contacts 5 in this embodiment are formed on the switch base 2 at one time, thereby achieving a simple and reliable structure and a low cost.

Figure 3:
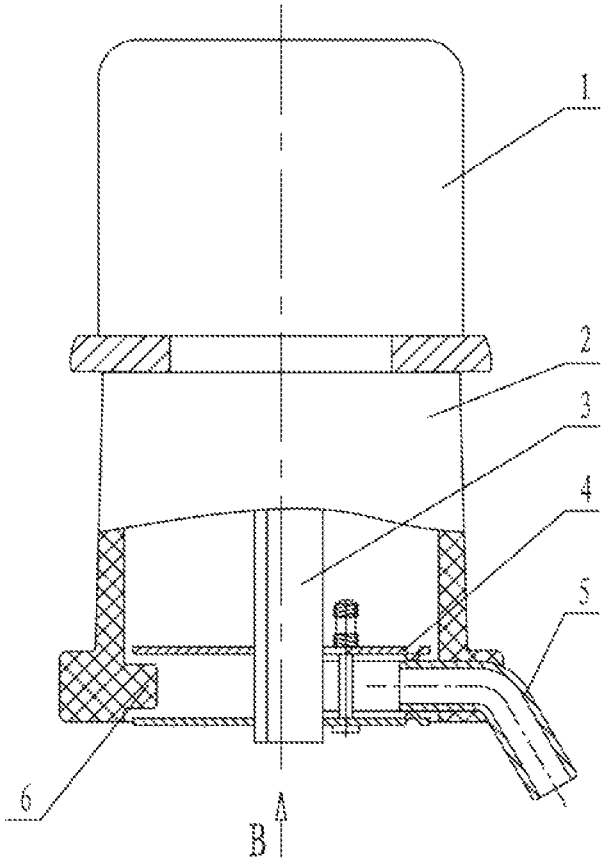
FIG. 3 is a front view of a disk type off-circuit tap changer according to another embodiment of the present invention.
Figure 4:
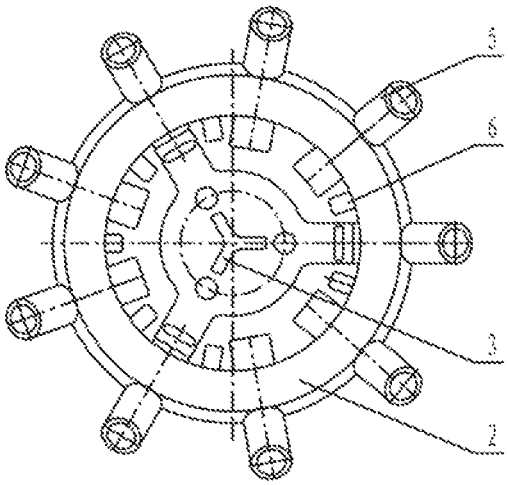
FIG. 4 is a B-direction view of the off-circuit tap changer shown in FIG. 3.

FIGS. 3 and 4 show a three-phase disk type off-circuit tap changer of neutral-point voltage regulations according to another embodiment of the present invention. The difference between the disk type off-circuit tap changer shown in FIGS. 3 and 4 and the disk type off-circuit tap changer shown in FIGS. 1 and 2 lies in the moving contact 4. The moving contact 4 is an upper-and-lower clip-type moving contact. The moving contact 4 in this embodiment includes upper and lower clip-type moving contact pieces, and a ternate slot formed at the middle of the moving contact piece and connected to a lower end of the rotation shaft in an insertion manner. The upper-and-lower clip-type moving contact pieces fit with the fixed contacts circumferentially arranged at a lower side of the switch base. The upper-and-lower clip-type moving contact pieces have three contact points that are circumferentially arranged and are conductive to each other. There are three sets of fixed contacts corresponding to the layout of the moving contacts. Each set includes three to five fixed contacts, a contact terminal of each upper-and-lower clip-type moving contact piece is in contacted with a fixed contact in each corresponding set, so that translocation and transformation can be performed. An insulating boss 6 is disposed between two adjacent fixed contacts, the insulating boss and the switch base form a whole body, and the fixed contacts are directly embedded into the switch base and are integrally formed with the switch base and the insulating boss through injection molding, to form a switch base in an integrated structure. The fixed contacts and the insulating boss of this embodiment are formed on the switch base at one time, thereby achieving a simple and reliable structure and a low cost.

The present invention recites, among other things, a disk type off-circuit tap changer, and has at least the following beneficial effects: (1). the fixed contacts are directly embedded into the switch base, and the switch base, the fixed contacts and an insulating boss are integrally formed, which makes the structure of the tap changer simple and the positioning accurate, whereby it is easy to process and manufacture the tap changer, and the manufacturing cost is low; (2). the tap changer in an integrated structure has high manufacturing and assembly precision, and high operational reliability; and (3). the fixed contact is in a shape of a cylinder or a flat column, so that the gear shifting for the moving contact is easy. The present invention is applicable to a disk-shaped off-circuit tap changer with various voltage regulating manners.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A disk type off-circuit tap changer, comprising:

a switch base; and a rotation shaft, wherein an upper end of the rotation shaft is connected to an operation positioning mechanism, a lower end of the rotation shaft is connected to moving contacts, wherein the moving contacts fit with fixed contacts circumferentially arranged at a lower side of the switch base, and wherein the fixed contacts are directly embedded into the switch base to form an integrated body with the switch base, wherein the fixed contacts and the switch base are integrally formed through injection molding or compression molding; and wherein the moving contact is an upper-and-lower clip-type moving contact and comprises an insulating drive plate and upper-and-lower clip moving contact pieces, wherein a ternate slot is formed at the middle of the insulating drive plate and is connected to a lower end of the rotation shaft in an insertion manner, the upper-and-lower clip-type moving contact pieces fit with the fixed contacts circumferentially arranged at a lower side of the switch base, and each upper-and-lower clip moving contact piece has three moving contact terminals circumferentially arranged and nonconductive to each other, wherein the fixed contact is in a shape of a cylinder with a front end extending into an inner cavity of the switch base to form a contact terminal, and a rear end extending out of the switch base and being bent downwards to form a wiring end, wherein the cylindrical fixed contact is a hollow tube and is manufactured by using a copper tube material, wherein three sets of fixed contacts corresponding to the moving contacts are disposed, each set of fixed contacts comprises six fixed contacts, each upper-and-lower clip-type moving contact piece spans between two fixed contacts in each corresponding set, so as to perform translocation and transformation, thereby forming the three-phase disk type off-circuit tap changer.

2. A disk type off-circuit tap changer, comprising:

a switch base; and a rotation shaft, wherein an upper end of the rotation shaft is connected to an operation positioning mechanism, a lower end of the rotation shaft is connected to moving contacts, wherein the moving contacts fit with fixed contacts circumferentially arranged at a lower side of the switch base, and wherein the fixed contacts are directly embedded into the switch base to form an integrated body with the switch base, wherein the fixed contacts and the switch base are integrally formed through injection molding or compression molding; and wherein an insulating boss is formed between the fixed contacts, and the insulating boss and the switch base form an integrated body and are integrally formed through injection molding or compression molding; and wherein the moving contact is formed by two upper and lower clip moving contact pieces, wherein a ternate slot is formed at the middle of the moving contact piece and is connected to a lower end of the rotation shaft in an insertion manner, the upper-and-lower clip-type moving contact pieces fit with the fixed contacts circumferentially arranged at a lower side of the switch base, wherein each upper-and-lower clip moving contact piece has three moving contact terminals circumferentially arranged and conductive to each other, wherein three sets of fixed contacts corresponding to the moving contacts are disposed, each set comprises three to five fixed contacts, wherein a contact terminal of each upper-and-lower clip moving contact piece is in contact with a fixed contact in each corresponding set, so as to perform translocation and transformation, thereby forming the three-phase disk type off-circuit tap changer of neutral-point voltage regulations.

3. A disk type off-circuit tap changer, comprising:

a switch base; and a rotation shaft, wherein an upper end of the rotation shaft is connected to an operation positioning mechanism, a lower end of the rotation shaft is connected to moving contacts, wherein the moving contacts fit with fixed contacts circumferentially arranged at a lower side of the switch base, and wherein the fixed contacts are directly embedded into the switch base to form an integrated body with the switch base, and wherein each moving contact is an upper-and-lower clip-type moving contact, wherein a ternate slot is formed at the middle of the moving contact and is connected to a lower end of the rotation shaft in an insertion manner.

4. The disk type off-circuit tap changer according to claim 3, wherein each fixed contact is in a shape of a cylinder or a flat column, wherein a front end thereof extends into an inner cavity of the switch base to form a contact terminal, and a rear end thereof extends out of the switch base and is bent downwards to form a wiring end.

5. The disk type off-circuit tap changer according to claim 3, wherein each fixed contact is in a shape of a flat column at the front and in a shape of a cylinder at the rear, wherein a contact terminal at the front end stretching into an inner cavity of the switch base is in a shape of a flat column, a wiring end at the rear stretching out of the switch base and bent downwards is in a shape of a cylinder, and a middle section is a gradient transition section between the flat column and cylinder.

6. The disk type off-circuit tap changer according to claim 3, wherein the fixed contact in a shape of a cylinder or a flat column is a hollow tube, and is manufactured by using tube materials.

7. The disk type off-circuit tap changer according to claim 3, wherein the switch base is an integrated structure.

8. The disk type off-circuit tap changer according to claim 7, wherein the fixed contacts and the switch base are integrally formed through injection molding or compression molding.

9. The disk type off-circuit tap changer according to claim 8, wherein the moving contact is an upper-and-lower clip-type moving contact and comprises an insulating drive plate and upper-and-lower clip moving contact pieces, wherein a ternate slot is formed at the middle of the insulating drive plate and is connected to a lower end of the rotation shaft in an insertion manner, the upper-and-lower clip-type moving contact pieces fit with the fixed contacts circumferentially arranged at a lower side of the switch base, and each upper-and-lower clip-type moving contact piece has three moving contact terminals circumferentially arranged and nonconductive to each other, wherein the fixed contact is in a shape of a cylinder with a front end extending into an inner cavity of the switch base to form a contact terminal, and a rear end extending out of the switch base and being bent downwards to form a wiring end, wherein the cylindrical fixed contact is a hollow tube and is manufactured by using a copper tube material, wherein three sets of fixed contacts corresponding to the moving contacts are disposed, each set of fixed contacts comprises six fixed contacts, each upper-and-lower clip-type moving contact piece spans between two fixed contacts in each corresponding set, so as to perform translocation and transformation, thereby forming the three-phase disk type off-circuit tap changer.

10. The disk type off-circuit tap changer according to claim 8, wherein an insulating boss is formed between the fixed contacts, and the insulating boss and the switch base form an integrated body and are integrally formed through injection molding or compression molding.

11. The disk type off-circuit tap changer according to claim 10, wherein the moving contact is formed by two upper and lower clip moving contact pieces, wherein a ternate slot is formed at the middle of the moving contact piece and is connected to a lower end of the rotation shaft in an insertion manner, the upper-and-lower clip-type moving contact pieces fit with the fixed contacts circumferentially arranged at a lower side of the switch base, wherein each upper-and-lower clip moving contact piece has three moving contact terminals circumferentially arranged and conductive to each other, wherein three sets of fixed contacts corresponding to the moving contacts are disposed, each set comprises three to five fixed contacts, wherein a contact terminal of each upper-and-lower clip moving contact piece is in contact with a fixed contact in each corresponding set, so as to perform translocation and transformation, thereby forming the three-phase disk type off-circuit tap changer of neutral-point voltage regulations.

* * * * *